US009299293B2

(12) United States Patent
Wan et al.

(10) Patent No.: US 9,299,293 B2
(45) Date of Patent: Mar. 29, 2016

(54) METHODS AND APPARATUS FOR BACKLIGHTING DUAL MODULATION DISPLAY DEVICES

(71) Applicant: DOLBY LABORATORIES LICENSING CORPORATION, San Francisco, CA (US)

(72) Inventors: Chun Chi Thomas Wan, Mountain View, CA (US); Giorgio Giaretta, Scotch Plains, NJ (US); Lewis Johnson, Delta (CA); Ka Wing Terence Lau, Burnaby (CA); Christopher Orlick, Washington Crossing, PA (US); Neil Messmer, Langley (CA)

(73) Assignee: Dobly Laboratories Licensing Corporation, San Francisco, CA (US)

( * ) Notice: Subject to any disclaimer, the term of this patent is extended or adjusted under 35 U.S.C. 154(b) by 46 days.

(21) Appl. No.: 14/347,209

(22) PCT Filed: Oct. 12, 2012

(86) PCT No.: PCT/US2012/060055
§ 371 (c)(1),
(2) Date: Mar. 25, 2014

(87) PCT Pub. No.: WO2013/056117
PCT Pub. Date: Apr. 18, 2013

(65) Prior Publication Data

US 2014/0253609 A1 Sep. 11, 2014

Related U.S. Application Data

(60) Provisional application No. 61/546,822, filed on Oct. 13, 2011.

(51) Int. Cl.
*G09G 3/34* (2006.01)
*G09G 3/32* (2006.01)

(52) U.S. Cl.
CPC ..... *G09G 3/3413* (2013.01); *G09G 3/32* (2013.01); *G09G 3/3426* (2013.01); *G09G 2320/0646* (2013.01); *G09G 2320/0666* (2013.01); *G09G 2340/06* (2013.01)

(58) Field of Classification Search
CPC ..... G09G 3/3406; G09G 2320/0646; G09G 2360/16; G09G 2330/021; G09G 2320/064
USPC ..... 345/102
See application file for complete search history.

(56) References Cited

U.S. PATENT DOCUMENTS 6,950,109 B2 9/2005 Deering
7,023,543 B2 4/2006 Cunningham (Continued)

FOREIGN PATENT DOCUMENTS

GB 2395074 5/2004
WO 03/077013 9/2003

(Continued)

OTHER PUBLICATIONS

Ying, Shang Ping et al "Characterizing LEDs for Mixture of Colored LED Light Sources" Electronic Materials and Packaging International Conference, pp. 1-5, Dec. 2006.

(Continued)

*Primary Examiner* — MD Saiful A Siddiqui

(57) ABSTRACT

Methods and apparatus are provided for backlighting a dual modulation display device. Each type of light source comprises a multi-primary light source having two or more primary color light emitters having different primary color characteristics from corresponding primary color emitters of other types of light source. Methods may comprise receiving illumination target values for a plurality of locations on the front modulator corresponding to the plurality of light sources, each of the locations on the front modulator configured to be illuminated by two or more of the plurality of light sources, determining primary color drive values source based on the primary color characteristics for that primary color and the illumination target value for the location corresponding to that light source, and driving the primary color light emitters or each type of light source based on the primary color drive values.

20 Claims, 10 Drawing Sheets

(56) References Cited

U.S. PATENT DOCUMENTS

| | | | | |
|---|---|---|---|---|
| 7,626,345 | B2 | 12/2009 | Young | |
| 7,671,542 | B2 | 3/2010 | Chang | |
| 7,859,554 | B2 | 12/2010 | Young | |
| 2005/0018226 | A1 | 1/2005 | Chiba | |
| 2006/0227085 | A1 | 10/2006 | Boldt, Jr. | |
| 2006/0290624 | A1 | 12/2006 | Ashdown | |
| 2007/0159448 | A1 | 7/2007 | Inuzuka | |
| 2008/0122832 | A1 | 5/2008 | Chen | |
| 2009/0009092 | A1 | 1/2009 | Routledge | |
| 2010/0052575 | A1 | 3/2010 | Feng | |
| 2010/0072900 | A1 | 3/2010 | Deppe | |
| 2010/0079365 | A1 | 4/2010 | Feng | |
| 2010/0110098 | A1 | 5/2010 | Wang | |
| 2010/0118057 | A1 | 5/2010 | Atkins | |
| 2010/0118374 | A1 | 5/2010 | Quach | |
| 2010/0245228 | A1 | 9/2010 | Chen | |
| 2010/0277905 | A1 | 11/2010 | Janik | |
| 2010/0309107 | A1 * | 12/2010 | Muroi et al. | 345/88 |
| 2011/0012512 | A1 | 1/2011 | Young | |
| 2011/0026256 | A1 | 2/2011 | Szolyga | |
| 2011/0042584 | A1 | 2/2011 | Bechtel | |
| 2011/0062872 | A1 | 3/2011 | Jin | |
| 2011/0062874 | A1 | 3/2011 | Knapp | |
| 2011/0115827 | A1 | 5/2011 | Tanaka | |
| 2012/0044281 | A1 * | 2/2012 | Kang | 345/690 |
| 2012/0281028 | A1 | 11/2012 | Orlick | |

FOREIGN PATENT DOCUMENTS

| | | |
|---|---|---|
| WO | 2006/010244 | 2/2006 |
| WO | 2007/066264 | 6/2007 |
| WO | 2007/069149 | 6/2007 |
| WO | 2008/092276 | 8/2008 |
| WO | 2009/093895 | 7/2009 |
| WO | WO2010/127080 | * 11/2010 |
| WO | 2010/151600 | 12/2010 |

OTHER PUBLICATIONS

Bhattacharya, A et al. "A Probabilistic Approach of Designing Driving Circuits for Strings of High-Brightness Light Emitting Diodes" Jun. 2007, Power Electronics Specialists Conference, pp. 1429.

Ashdown, Ian et al. "Neural Networks For Led Color Control" SPIE Proc. Volume 5187, Third International Conference on Solid State Lighting, 215, Jan. 26, 2004.

Ashdown, I. et al "Binning and Filtering: The Six-Color Solution" Proc. SPIE 6337, Sixth International Conference on Solid State Lighting, Sep. 12, 2006, Conference vol. 6337.

Bernitz, F. et al "Advanced Electronic Driver for Power LEDs With Integrated Colour Management" vol. 5, pp. 2604-2607, Dec. 2006.

Hsieh, Yuan-Ta, et al "A High Current Accuracy Boost White LED Driver Based on Offset Calibration Technique" Circuits and Systems, Transactions on IEEE, vol. 58, Issue 4, published in Apr. 2011, pp. 244-248.

* cited by examiner

METHODS AND APPARATUS FOR BACKLIGHTING DUAL MODULATION DISPLAY DEVICES

CROSS-REFERENCE TO RELATED APPLICATIONS

This application claims priority to U.S. Provisional Application No. 61/546,822, filed Oct. 13, 2011, which is hereby incorporated by reference in its entirety.

TECHNICAL FIELD

The invention relates to dual modulation display devices.

BACKGROUND

Process variations in the manufacturing of light-emitting diodes and other solid-state illumination sources can cause variations in the spectral composition of emitted light. For example, LEDs may be designed to emit light in a band of wavelengths centered at a specific wavelength. Process variations during manufacturing can cause the individual LEDs to emit light in bands that are shifted from the designed-for wavelengths by various amounts. LED manufacturers typically sort LEDs into "bins". The bins may be defined, for example, based on the chromaticity of the emitted light as well as other factors, such as the intensity of the emitted light. The cost for purchasing LEDs can vary significantly depending upon the bin.

LEDs may be used for illumination in a wide variety of applications. For example, arrays of LEDs may be used as the backlights in computer displays, televisions, and other displays. Arrays of LEDs may also be used as illumination sources in architectural lighting and other fields. In fields where the chromaticity of the light is important, such as in high quality displays, some prior art solutions require LEDs having tightly controlled and/or matched light outputs. This can be expensive. Other prior art solutions require LEDs to be controlled to compensate for deviations in color between different LEDs.

There exist a number of prior art publications relating to the use of light sources with different color characteristics. Examples include:

US 2011/0026256;
US 2006/0227085;
US 2010/0245228;
US 2010/0110098;
US 2010/0072900;
WO 2009/093895;
US 2008/0122832; and,
US 2010/0118057.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect provides a method for backlighting a dual modulation display device comprising a front modulator illuminated by a backlight comprising a plurality of light sources of two or more types, each type of light source comprising a multi-primary light source having two or more primary color light emitters having different primary color characteristics from corresponding primary color emitters of other types of light source. The method comprises receiving illumination target values for a plurality of locations on the front modulator corresponding to the plurality of light sources, each of the locations on the front modulator configured to be illuminated by two or more of the plurality of light sources, determining primary color drive values for each primary color of each type of light source based on the primary color characteristics for that primary color and the illumination target value for the location corresponding to that light source, and, driving the primary color light emitters or each type of light source based on the primary color drive values.

Another aspect provides apparatus for generating backlight driving signals for a dual modulation display device comprising a front modulator illuminated by a backlight comprising a plurality of light sources of two or more types, each type of light source comprising a multi-primary light source having two or more primary color light emitters having different primary color characteristics from corresponding primary color emitters of other types of light source. The apparatus comprises an illumination target value generator configured to generate illumination target values for a plurality of locations on the front modulator corresponding to the plurality of light sources, each of the locations on the front modulator configured to be illuminated by two or more of the plurality of light sources, and, a multi-primary calculator configured to determine primary color drive values for each primary color of each type of light source based on the primary color characteristics for that primary color and the illumination target value for the location corresponding to that light source and output the primary color drive values to a backlight driving circuit.

In addition to the exemplary aspects and embodiments described above, further aspects and embodiments will become apparent by reference to the drawings and by study of the following detailed descriptions.

BRIEF DESCRIPTION OF DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

A dual modulation display typically has a front modulator which is illuminated by a spatially variable backlight. Some types of dual modulation displays have a backlight comprising a two dimensional array of light sources which are controlled, either individually or in groups, to emit varying amounts of light based on image data so as to generate a desired illumination pattern on the front modulator. The front modulator comprises a plurality of controllable elements which are each individually operable to transmit a desired amount of the light from the backlight through to a viewing location. The number of light sources of the backlight is generally much lower than the number of controllable elements of the front modulator. The light sources of the backlight may comprise solid state light sources such as LEDs or other types of light sources. The front modulator may, for example, comprise a liquid crystal display (LCD) or other spatial light modulator.

In many situations it is important to precisely control the color of light emitted by the backlight of a dual modulation display. Some prior art solutions address this need by ensuring that all of the light sources of the backlight have the same color characteristics. Other prior art solutions address this need by compensating for any color variations in the light sources of the backlight such that the light sources of the backlight each emit light with substantially the same color characteristics. The inventors have determined that through appropriate control of a backlight having a plurality of types of light sources with different color characteristics, desired target colors may be achieved without forcing the different light sources to emit light with the same color characteristics. In some embodiments such backlights may be controlled in a way to take advantage of the different color characteristics of the light sources so as to provide an increased color gamut of light emitted by the backlight, and to reduce undesired metameric effects.

Figure 1:
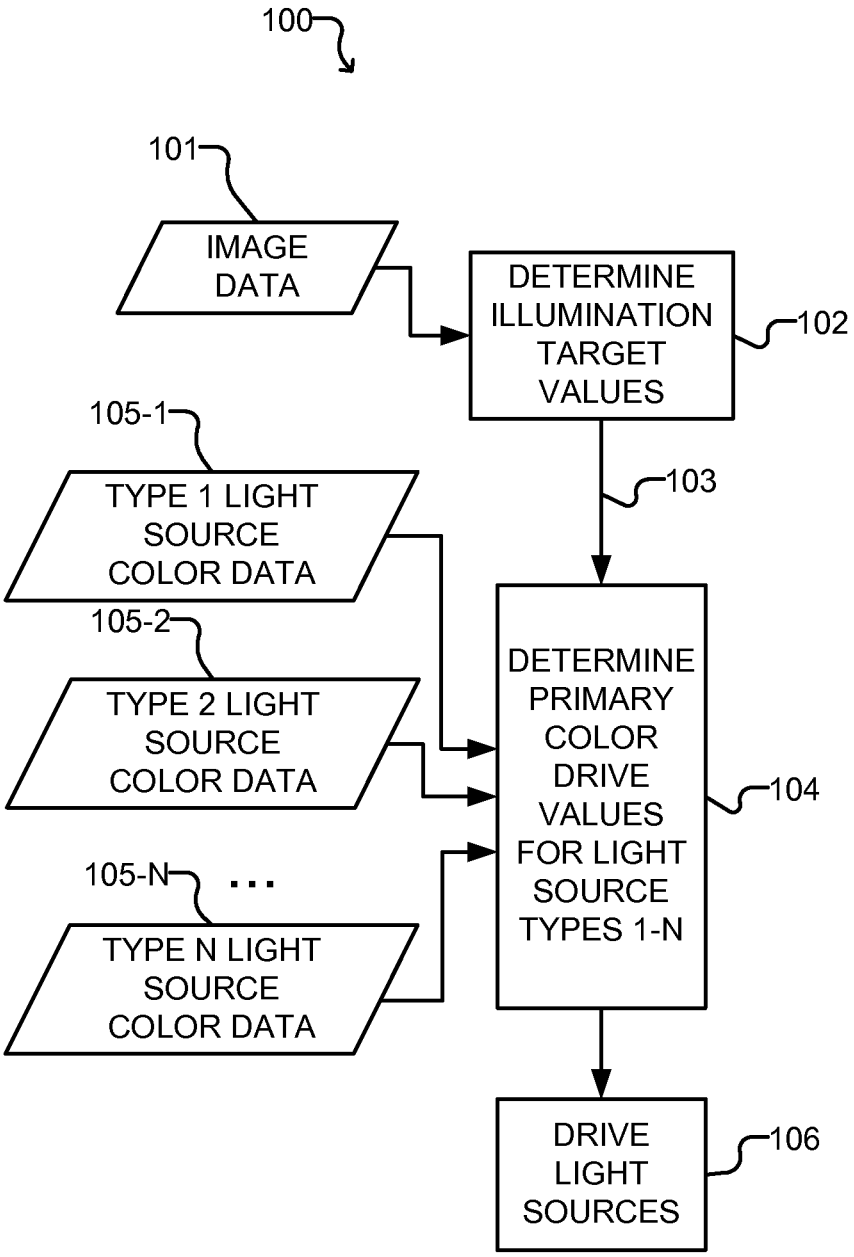
FIG. 1 is a flowchart illustrating an example method for driving light sources having different color characteristics according to one embodiment.

FIG. 1 shows an example method 100 according to one embodiment. Method 100 may be carried out, for example, by one or more processing elements in a dual modulation display device comprising a backlight having a plurality of different types of light sources, each light source comprising two or more primary color emitters having different color characteristics from the primary color emitters of other types of light source, or by one or more processing elements in a separate device configured to be connected to such a dual modulation display device. In some embodiments, processing elements provided to carry out example methods described herein may comprise linear solvers configured to solve linear equation systems as described below.

Figure 2A:
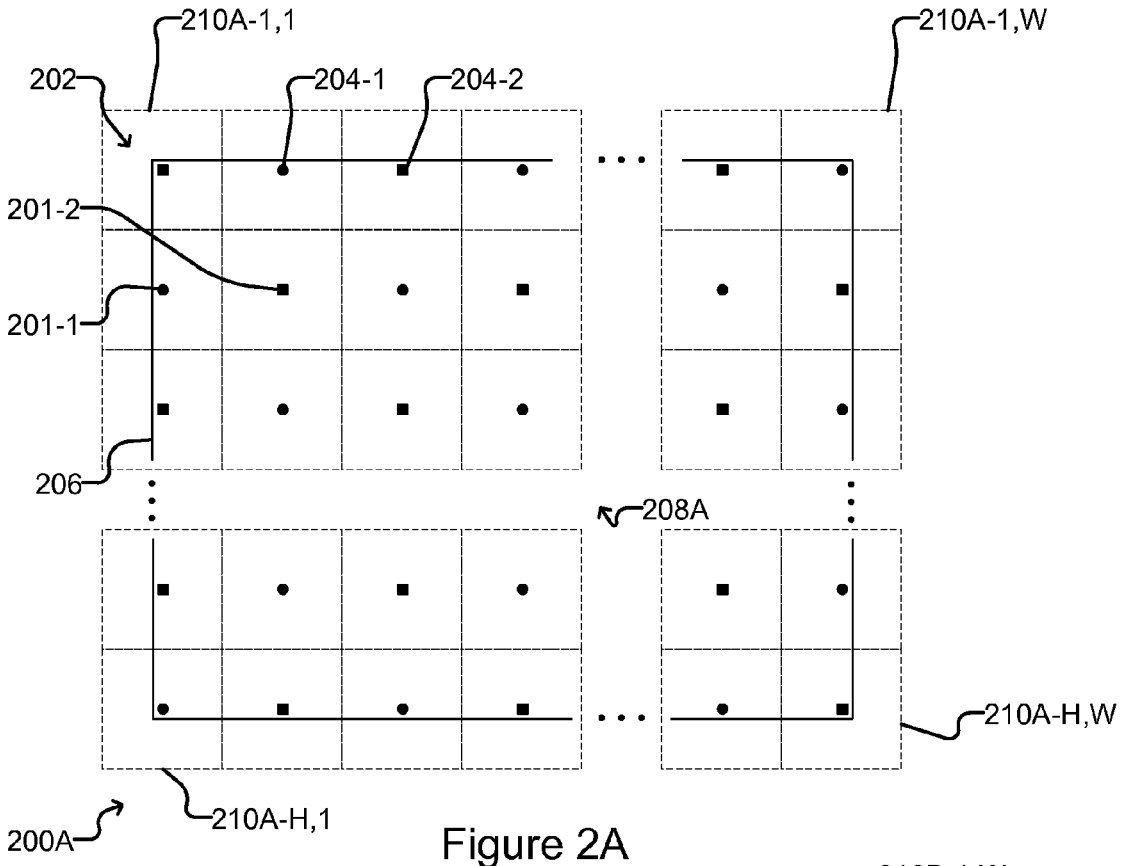
FIG. 2A schematically illustrates a dual modulation display according to one embodiment.
Figure 2B:
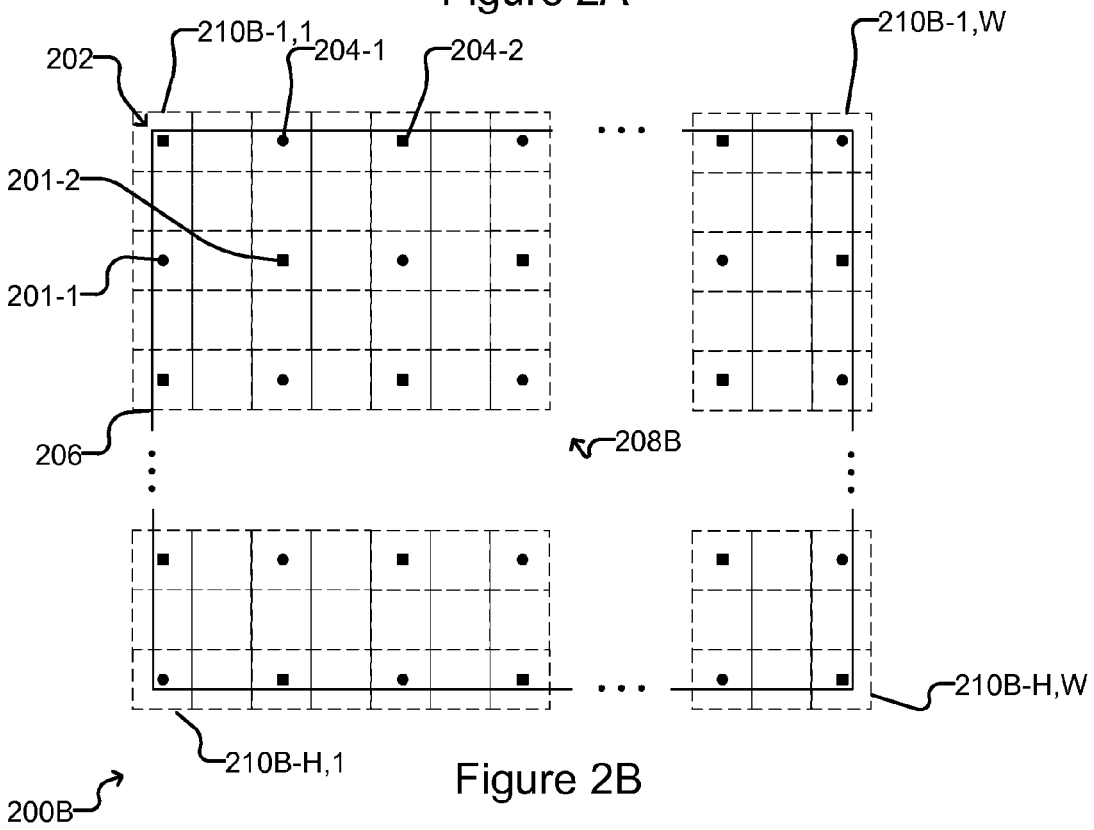
FIG. 2B schematically illustrates a dual modulation display according to one embodiment.

FIGS. 2A and 2B schematically illustrate components of example dual modulation devices 200A and 200B, each comprising an array 202 of light sources which are configured to illuminate a front modulator 206. In the illustrated examples, array 202 comprises a regular rectangular array of two types of light sources 204-1 and 204-2 arranged in alternating fashion, but it is to be understood that array 202 could comprise more than two types of light sources, and the light sources may be arranged in a different type of regular array (e.g., a triangular, hexagonal, or other array), or even in an irregular array. Light sources 204-1 and 204-2 may each comprise multi-primary light sources. As used herein, the term "multi-primary light source" refers to a light source having two or more individually controllable primary color light emitters which emit light in bands which are centered at different wavelengths. The examples discussed herein refer to multi-primary light sources having three primary color light emitters (e.g., red, green and blue), but it is to be understood the techniques described herein may be applied to multi-primary light sources having a different number primary color light emitters (e.g., four color light sources having red, green, blue and yellow, or red, green, blue and white primary color light emitters). For example, light sources 204-1 and 204-1 of FIGS. 2A and 2B may each comprise so-called "RGB LEDs" selected from different "bins", which each have a red, a green and a blue light emitter, where the spectral characteristics of the red, green and blue light emitters of light sources 204-1 are different from those of the red, green and blue light emitters of light sources 204-2.

Returning to FIG. 1, method 100 begins at step 102, where image data 101 specifying a desired image is processed to determine illumination target values 103. Image data 101 may specify the desired image at a higher resolution than the resolution of the backlight. In some embodiments, image data 101 may specify the desired image at a resolution equal to that of the front modulator of the dual modulation display device. Due to the resolution mismatch between image data 101 and the light sources of the backlight, determining illumination target values 103 at step 102 typically involves downsampling image data 101 into a resolution closer or equal to that of the light sources of the backlight. For example, FIG. 2A illustrates an example downsample grid 208A having downsample blocks 210A (individually labelled 210A-1,1 to 210A-H,W) at the same resolution as the light sources of the backlight. FIG. 2B illustrates an example downsample grid 208B having downsample blocks 210B (individually labelled 210B-1,1 to 210B-H,W) at twice the resolution in each direction as the light sources of the backlight. In each of grids 208A and 208B, downsample blocks may be referred to using a suffix having the form of "-row,column", although only the downsample blocks in the corners are labelled in FIGS. 2A and 2B.

Determining the target illumination values 103 at step 102 also typically involves spatially filtering the downsampled image data to ensure that target values for adjacent downsample blocks are similar so that the front modulator is illuminated with a pattern of light which varies smoothly, thereby avoiding sharp transitions in the illumination pattern of the backlight, which may cause unwanted artifacts. In some embodiments, determining the illumination target values may comprise determining statistical attributes of the downsample blocks as described, for example, in International Application No. PCT/US2010/059642, which is hereby incorporated by reference herein. Determining the target illumination values

103 at step 102 may also involve linearizing the image data to remove any "gamma" factor present in the image data. Determining the target illumination values at step 102 may also involve conversion from the color space used in image data 101 into a tristimulus color space. For example, in some embodiments image data is specified in an RGB color space and converted into the CIE XYZ color space such that for each downsample block an illumination target value $XYZ_T$ is determined. However, it is to be understood that the illumination target values 103 may be specified using other color spaces, such as, for example the CIE LUV color space, or other suitable color spaces.

Once the illumination target values 103 are determined, method 100 proceeds to step 104, where primary color drive values are determined for each of the different types of light sources in the backlight. The primary color drive values are determined at block 104 based on color data 105-1 to 105-N for each of N different types of light sources, as described further below. Each color data 105-1 to 105-N specifies the color response of the respective type of light source when driven with given drive values. Color data 105-1 to 105-N may be obtained, for example, from the manufacturer(s) of the light sources, or through calibration, and may be stored in memory accessible to the processing elements carrying out method 100. Once the primary color drive values are determined in step 104, method 100 proceeds to step 106, where the light sources of the backlight are driven with the primary color drive values. Driving multi-primary light sources to emit light with different primary color characteristics may provide a larger gamut than may be achievable by emitting light with uniform primary color characteristics. Also, by providing color mixtures produced from light emitted with different primary color characteristics a wider range of frequencies may be presented to a viewer, which may reduce undesired metameric effects which can arise due to small differences between optic nerve responses between different people.

In one embodiment, primary color drive values may be determined at step 104 for each of the different types of light sources by considering all of the light sources of the backlight together. The may be accomplished, for example, by providing a linear system based on primary color characteristics of the different types of light sources. For example, an illumination target value $XYZ_{1T}$ at the location corresponding to a first light source may be expressed as:

$$\begin{bmatrix} X_{1T} \\ Y_{1T} \\ Z_{1T} \end{bmatrix} = R_1 \begin{bmatrix} X_{1r} \\ Y_{1r} \\ Z_{1r} \end{bmatrix} + G_1 \begin{bmatrix} X_{1g} \\ Y_{1g} \\ Z_{1g} \end{bmatrix} + B_1 \begin{bmatrix} X_{1b} \\ Y_{1b} \\ Z_{1b} \end{bmatrix} + {}_1\beta_2 R_2 \begin{bmatrix} X_{2r} \\ Y_{2r} \\ Z_{2r} \end{bmatrix} + {}_1\beta_2 G_2 \begin{bmatrix} X_{2g} \\ Y_{2g} \\ Z_{2g} \end{bmatrix} + {}_1\beta_2 B_2 \begin{bmatrix} X_{2b} \\ Y_{2b} \\ Z_{2b} \end{bmatrix} + \ldots + {}_1\beta_n R_n \begin{bmatrix} X_{nr} \\ Y_{nr} \\ Z_{nr} \end{bmatrix} + {}_1\beta_n G_n \begin{bmatrix} X_{ng} \\ Y_{ng} \\ Z_{ng} \end{bmatrix} + {}_1\beta_n B_n \begin{bmatrix} X_{nb} \\ Y_{nb} \\ Z_{nb} \end{bmatrix}$$

Where:

$XYZ_{1T}$ represents the XYZ target at the location for the first light source;

$R_n$, $G_n$, $B_n$ represents the primary color R, G and B drive values for the nth light source;

${}_1\beta_n$ represents the coupling factor of light spread energy from the light source at position n to the target first light source;

$X_{nr}$, $Y_{nr}$, $Z_{nr}$ represents the XYZ contribution of the red component of the nth light source;

$X_{ng}$, $Y_{ng}$, $Z_{ng}$ represents the XYZ contribution of the green component of the nth light source; and, $X_{nb}$, $Y_{nb}$, $Z_{nb}$ represents the XYZ contribution of the blue component of the nth light source.

The color data for each light source may be expressed in matrix form, with a matrix $M_1$ representing the color data of the $1^{st}$ light source and a matrix $M_n$ representing the color data of the nth light source, as follows:

$$M_1 = \begin{bmatrix} X_{1r} & X_{1g} & X_{1b} \\ Y_{1r} & Y_{1g} & Y_{1b} \\ Z_{1r} & Z_{1g} & Z_{1b} \end{bmatrix},$$

and $$M_n = \begin{bmatrix} X_{nr} & X_{ng} & X_{nb} \\ Y_{nr} & Y_{ng} & Y_{nb} \\ Z_{nr} & Z_{ng} & Z_{nb} \end{bmatrix}$$

Then, the illumination target value $XYZ_{1T}$ can be written as:

$$\begin{bmatrix} X_{1T} \\ Y_{1T} \\ Z_{1T} \end{bmatrix} = [\, M_1 \quad {}_1\beta_2 M_2 \quad \ldots \quad {}_1\beta_n M_n \,] \times \begin{bmatrix} R_1 \\ G_1 \\ B_1 \\ R_2 \\ G_2 \\ B_2 \\ \vdots \\ R_n \\ G_n \\ B_n \end{bmatrix}$$

The illumination target value at the location of each of the light sources may similarly expressed, and combined to yield:

$$\begin{bmatrix} X_{1T} \\ Y_{1T} \\ Z_{1T} \\ X_{2T} \\ Y_{2T} \\ Z_{2T} \\ \vdots \\ X_{nT} \\ Y_{nT} \\ Z_{nT} \end{bmatrix} = \begin{bmatrix} M_1 & {}_1\beta_2 M_2 & \ldots & {}_1\beta_n M_n \\ \ldots & \ldots & \ldots & \ldots \\ {}_n\beta_1 M_1 & {}_n\beta_2 M_2 & \ldots & M_n \end{bmatrix} \times \begin{bmatrix} R_1 \\ G_1 \\ B_1 \\ R_2 \\ G_2 \\ B_2 \\ \vdots \\ R_n \\ G_n \\ B_n \end{bmatrix}$$

Given the illumination target values for locations corresponding to each light source and the color data of each light source, the primary color drive values each primary color of each of the light sources may be determined by solving the above equation for $R_1G_1B_1 \ldots R_nG_nB_n$. Depending on the number of light sources and the capabilities of the processing elements, solving such a linear system may be practical in some embodiments. However, such a calculation may be computationally intensive, and may be simplified by taking advantage of the fact that the coupling factor of light spread energy from a light source drops off relatively quickly with distance from the light source, such that light sources which are far away from the location corresponding to a given light source (e.g. light sources which are separated from the given light source by one or more intervening light sources) make only negligible contributions to the illumination at that location in some embodiments. In some embodiments, only contributions from the nearest neighbors to a light source may be accounted for. In some embodiments, contributions from light sources farther away than the nearest neighbors to a light source may be accounted for, which may improve backlight accuracy in some situations.

Figure 3:
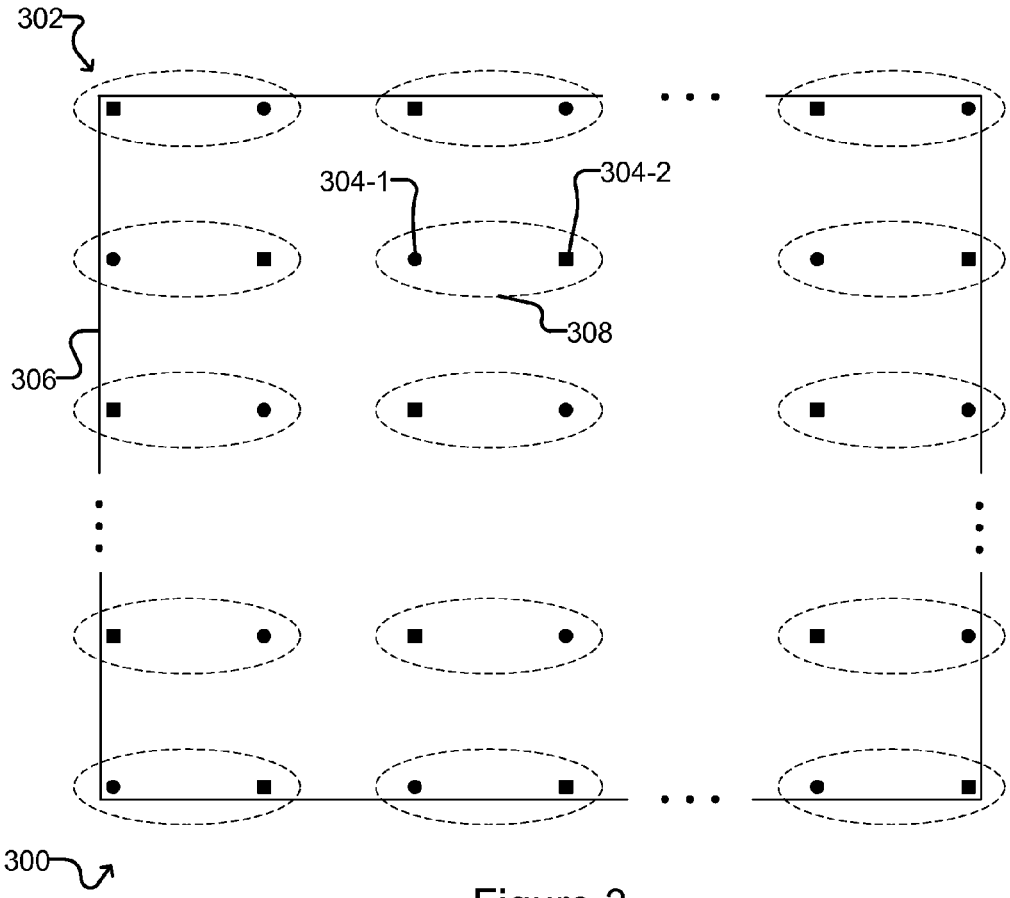
FIG. 3 schematically illustrates example spatial groupings of light sources of a dual modulation display according to one embodiment.

For example, in some embodiments the light sources may be considered in groups of two neighboring light sources. FIG. 3 shows an example display 300 comprising a regular rectangular array 302 of two types of LEDs 304-1 and 304-2 arranged in alternating fashion. Array 302 illuminates an LCD 306, comprising a plurality of controllable elements or pixels, which are controllable to transmit selected amounts of the light incident thereon at each pixel location. Each adjacent pair of horizontally neighboring light sources 304-1 and 304-2 may be considered together as indicated by spatial sample groupings 308. Other groupings of light sources are also possible. For example, in some embodiments groups of three or more light sources may be considered together. In some embodiments, groupings may be selected based on the arrangement of the light sources (which need not be a rectangular array as shown in FIG. 3 in all embodiments) and/or the spread functions of the light sources.

The above equation may be simplified when considering two neighboring light sources to become:

$$\begin{bmatrix} X_{1T} \\ Y_{1T} \\ Z_{1T} \\ X_{2T} \\ Y_{2T} \\ Z_{2T} \end{bmatrix} = \begin{bmatrix} M_1 & {}_1\beta_2 M_2 \\ {}_2\beta_1 M_1 & M_2 \end{bmatrix} \times \begin{bmatrix} R_1 \\ G_1 \\ B_1 \\ R_2 \\ G_2 \\ B_2 \end{bmatrix}$$

The RGB primary color drive values can be computed by solving the following linear equation (1):

$$\begin{bmatrix} R_1 \\ G_1 \\ B_1 \\ R_2 \\ G_2 \\ B_2 \end{bmatrix} = inv\left(\begin{bmatrix} M_1 & {}_1\beta_2 M_2 \\ {}_2\beta_1 M_1 & M_2 \end{bmatrix}\right) \times \begin{bmatrix} X_{1T} \\ Y_{1T} \\ Z_{1T} \\ X_{2T} \\ Y_{2T} \\ Z_{2T} \end{bmatrix} \quad \text{equation (1)}$$

Figure 4:
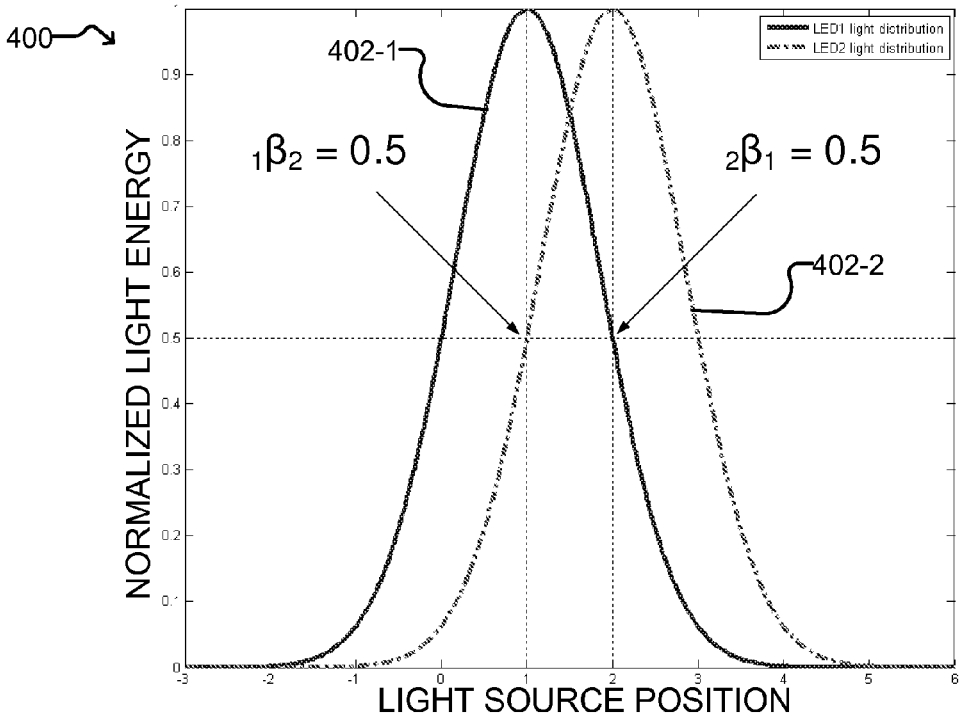
FIG. 4 is an example plot showing light energy as a function of distance for two neighboring light sources.

The Moore-Penrose pseudoinverse method or other suitable methods may be used to determine matrix inverses in this or other examples discussed herein. In a typical dual modulation display with a backlight comprising an array of multi-primary (e.g., RGB) LEDs, the LEDs are calibrated for luminance uniformity and the point spread function of the LEDs are very similar, even between LEDs from different bins having different primary color characteristics. Therefore, it is reasonable to assume that the light coupling from LED1 to LED 2 versus from LED 2 to LED1 are the same (i.e. ${}_1\delta_2={}_2\beta_1=\beta$). FIG. 4 shows an example graph 400 of light intensity (vertical axis) versus position (horizontal axis) showing example spread functions 402-1 and 402-2 for adjacent first and second types of LEDs.

The above linear equation (1) can be solved iteratively, and restrictions may be applied in each stage to limit or control the RGB values within the drivable range. The drivable range may, for example, depend on characteristics of the light sources and/or power consumption requirements. For example, in some situations the above linear equation (1) may have more than one solution, in which case any solutions with R, G or B values outside of the drivable range for the respective primary color emitter of the respective light source may be discarded in some embodiments. In some embodiments, the processing elements configured to implement a linear solver may be configured to bound the RGB outputs to within the drivable range by "clipping" any outputs outside of the drivable range to the endpoints of the drivable range. For example, if the drivable range is between 0 and 1, the solver may assign a value of 0 to any R, G or B value less than 0, and assign a value of 1 to any R, G or B value greater than 1.

Additional linear equations can be added into equation (1) to enforce additional requirements for the system. For example, it may be desirable to force the red primary color emitter of each type of LED to have the same primary drive value (e.g., because red LEDs from different are often more closely matched in color characteristics that other colors of LEDs). The above equation (1) may be modified to force the same red LED drive value by adding a condition of R1−R2=0, as follows:

$$\begin{bmatrix} X_{1T} \\ Y_{1T} \\ Z_{1T} \\ X_{2T} \\ Y_{2T} \\ Z_{2T} \\ 0 \end{bmatrix} = \begin{bmatrix} M_1 & {}_1\beta_2 M_2 \\ {}_2\beta_1 M_1 & M_2 \\ [1\ 0\ 0] & [-1\ 0\ 0] \end{bmatrix} \times \begin{bmatrix} R_1 \\ G_1 \\ B_1 \\ R_2 \\ G_2 \\ B_2 \end{bmatrix}$$

In this case, the RGB primary color drive values can be computed by solving the following linear equation (2):

$$\begin{bmatrix} R_1 \\ G_1 \\ B_1 \\ R_2 \\ G_2 \\ B_2 \end{bmatrix} = inv\left(\begin{bmatrix} M_1 & {}_1\beta_2 M_2 \\ {}_2\beta_1 M_1 & M_2 \\ [1\ 0\ 0] & [-1\ 0\ 0] \end{bmatrix}\right) \times \begin{bmatrix} X_{1T} \\ Y_{1T} \\ Z_{1T} \\ X_{2T} \\ Y_{2T} \\ Z_{2T} \\ 0 \end{bmatrix} \quad \text{equation (2)}$$

In the example method of determining primary color drive values discussed above, the coupling effect from a neighboring LED is controlled by the magnitude of the β value. The higher the β value, the more dependent the drive values for one LED is on the neighboring LED to achieve the desired illumination target.

In another embodiment, primary color drive values may be determined at step 104 for each of the different types of light sources by considering one light source at a time. As in the example above, this example will be discussed in terms of illumination target values in XYZ color space and two types of RGB LEDs from two different bins, but it is to be understood that this example method could be applied using any suitable types of light sources and color spaces.

The XYZ illumination target value for the location corresponding to any LED can be expressed by using the color data of the two bins of LEDs, as follows:

$$\begin{bmatrix} X_T \\ Y_T \\ Z_T \end{bmatrix} = [\, M_1 \quad M_2 \,] \times \begin{bmatrix} R_1 \\ G_1 \\ B_1 \\ R_2 \\ G_2 \\ B_2 \end{bmatrix}$$

Where:

$M_1$ and $M_2$ are the color data of the bin1 and LEDs the bin 2 LEDs, respectively, with $$M_1 = \begin{bmatrix} X_{1r} & X_{1g} & X_{1b} \\ Y_{1r} & Y_{1g} & Y_{1b} \\ Z_{1r} & Z_{1g} & Z_{1b} \end{bmatrix},$$

and $$M_2 = \begin{bmatrix} X_{2r} & X_{2g} & X_{2b} \\ Y_{2r} & Y_{2g} & Y_{2b} \\ Z_{2r} & Z_{2g} & Z_{2b} \end{bmatrix};$$

$R_1$, $G_1$, $B_1$ represents the RGB primary color drives for the bin1 LED; and $R_2$, $G_2$, $B_2$ represents the RGB primary color drives for the bin2 LED.

The RGB primary color drives for LEDs from either of two different bins at the location corresponding to a given illumination target value is determined by equation (3):

$$\begin{bmatrix} R_1 \\ G_1 \\ B_1 \\ R_2 \\ G_2 \\ B_2 \end{bmatrix} = inv([\, M_1 \quad M_2 \,]) \times \begin{bmatrix} X_T \\ Y_T \\ Z_T \end{bmatrix} \qquad \text{equation (3)}$$

Similarly to the example discussed above, additional linear equations can be added into equation (3) to enforce additional requirements for the system. For example, it may be desirable to force the red primary color emitter of each type of LED to have the same primary drive value (e.g., because red LEDs from different are often more closely matched in color characteristics that other colors of LEDs). The above equation (3) may be modified to force the same red LED drive value by adding a condition of R1−R2=0, as follows:

$$\begin{bmatrix} X_T \\ Y_T \\ Z_T \\ 0 \end{bmatrix} = \begin{bmatrix} M_1 & M_2 \\ [\,1 \;\; 0 \;\; 0\,] & [\,-1 \;\; 0 \;\; 0\,] \end{bmatrix} \times \begin{bmatrix} R_1 \\ G_1 \\ B_1 \\ R_2 \\ G_2 \\ B_2 \end{bmatrix}$$

In this case, the RGB primary color drive values can be computed by solving the following linear equation (4):

$$\begin{bmatrix} R_1 \\ G_1 \\ B_1 \\ R_2 \\ G_2 \\ B_2 \end{bmatrix} = inv\left(\begin{bmatrix} M_1 & M_2 \\ [\,1 \;\; 0 \;\; 0\,] & [\,-1 \;\; 0 \;\; 0\,] \end{bmatrix}\right) \times \begin{bmatrix} X_T \\ Y_T \\ Z_T \\ 0 \end{bmatrix} \qquad \text{equation (4)}$$

In embodiments wherein the illumination target values are determined using a wide spatial filter (e.g. a filter having a passband wider than the span of several LEDs), the difference in illumination target values between neighboring LEDs is moderate. In other words, any neighboring LED has a similar XYZ target to that of the LED under consideration, and provides color support for the location corresponding to the LED under consideration. As a result, only one set of RGB drives from equation (3) or (4) is selected to drive the LED located at the XYZ target. The RGB value corresponding to the bin of the LED under consideration at that location will be selected. For example, referring to FIG. 2A, for the illumination target value at downsample block 210A-1,1 the RGB drive for bin2 LED is extracted (i.e. $R_2$, $G_2$, and $B_2$). Similarly, for the illumination target value at downsample block 210A-1,2 the RGB drive for bin1 LED is selected (i.e. $R_1$, $G_1$, and $B_1$). Referring to FIG. 2B, for downsample blocks without a LED at the corresponding location (e.g., downsample blocks 210B-1,2 and 210-2,1) no drive values need be selected.

Figure 5:
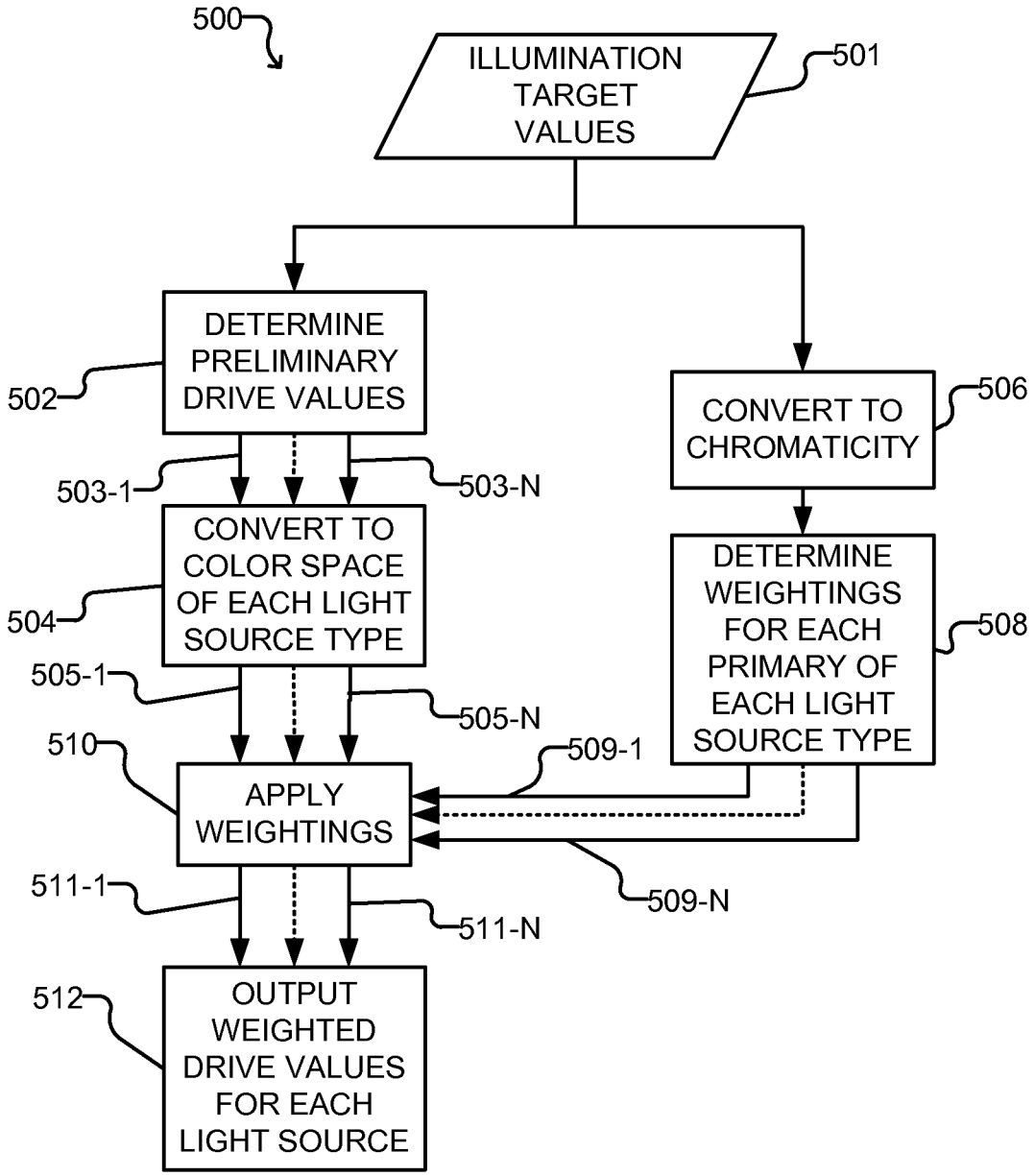
FIG. 5 is a flowchart illustrating an example method for determining drive values for light sources having different color characteristics according to one embodiment.

In another embodiment, primary color drive values may be determined at step 104 by a method which uses geometric weighing of primary colors of two types of light sources in chromaticity space. FIG. 5 shows an example method 500 according to such an embodiment. Method 500 will be discussed in terms of illumination target values in XYZ color space and two types of RGB LEDs from two different bins, but it is to be understood that this example method could be applied using any suitable types of light sources and color spaces.

Method 500 receives illumination target values 501 as an input, and at step 502 preliminary drive values 503-1 to 503-N are determined for each of N types of light sources. In embodiments with LEDs from 2 different bins arranged in a regular rectangular array, equal contribution from bin1 and bin2 LEDs to create the $XYZ_T$ may be reasonably assumed as a starting point. In such embodiments, preliminary drive values may be determined, for example, by dividing the illumination target value by two. At step 504 the preliminary drive values for each bin are converted into a color space corresponding to the color data for that bin's LEDs to generate light source type-specific preliminary drive values 505-1 to 505-N.

In parallel with determining the preliminary drive values, the illumination target values 501 are converted to chromaticity space (e.g. $xy_T$) at step 506. At step 508 weightings 509-1 to 509-N for each primary color of each light source type are determined based on geometric comparisons of each illumination target value and the primary color emitters of each light source type in chromaticity space, as discussed further below. In embodiments with RGB LED backlights, each weighting 509-1 to 509-N comprises a red, a green, and a blue weighting. At step 510 weightings 509-1 to 509-N are applied to light source type-specific preliminary drive values 505-1 to 505-N, respectively to generate weighted primary drive values 511-1 to 511-N. At step 512, the weighted primary drive values 511-1 to 511-N are outputted to drive the respective light sources.

The geometric weightings at step 508 may, for example, be determined by one of two methods. The first method is referred to as the "direct distance method", and the second method is referred to as the "orthogonal projection method". Methods such as method 500 which employ geometric weightings (such as those determined by the direct distance method and the orthogonal projection method) may provide more saturated LED drives than the linear solver methods described above, but may also be more susceptible to errors than such linear solver methods. The orthogonal projection method may provide the additional advantage of minimizing the difference in drive levels between the different types of light sources for target values near the white point in some embodiments. Both methods are described in terms of the CIE XYZ color space (and the CIE 1931 xy chromaticity space), but it is to be understood that these methods can also apply to other color spaces such as, for example, the CIE LUV space, or any other suitable color space.

Figure 6A:
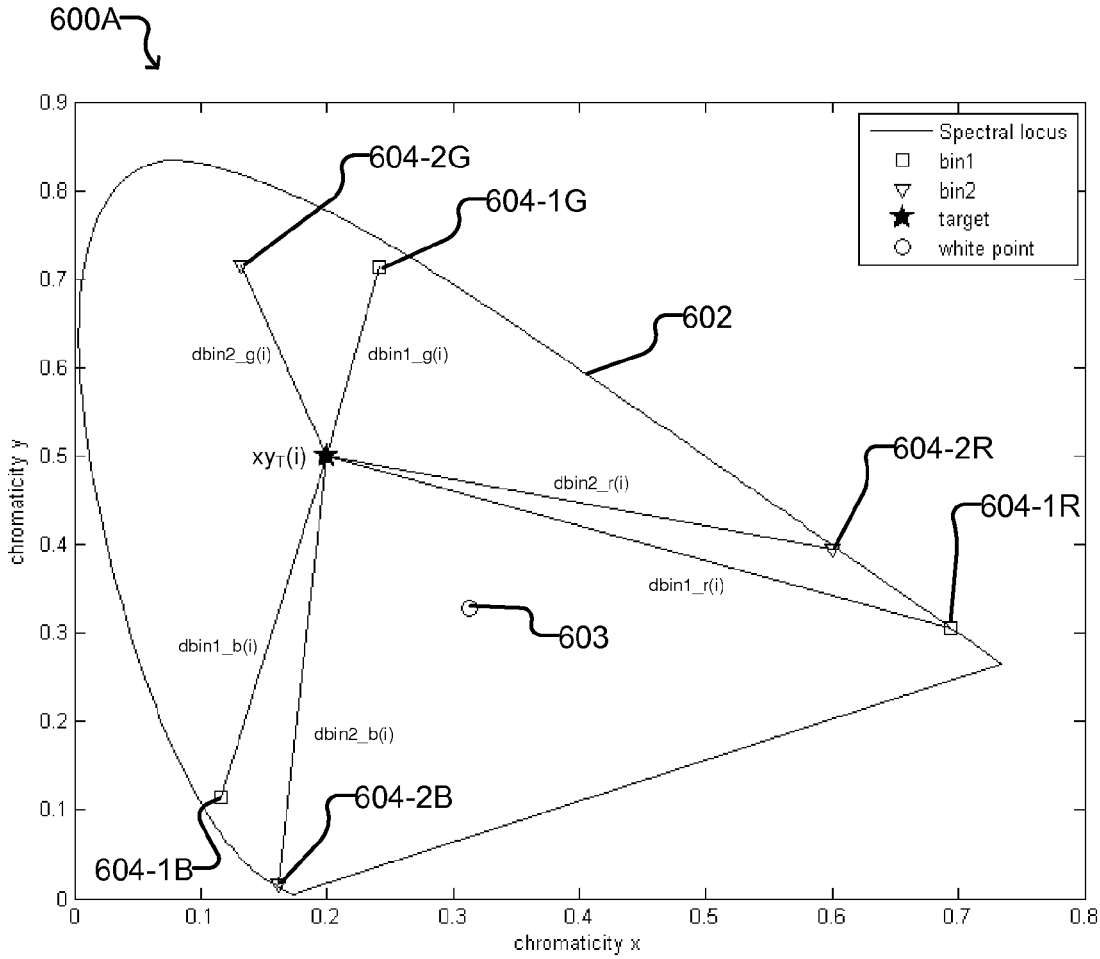
FIGS. 6A and 6B are example plots of primary colors of two different multi-primary light sources in chromaticity space, illustrating values used in calculating weightings for the of two different multi-primary light sources according to one embodiment.

FIG. 6A shows an example graph 600A illustrating values used in determining weightings using the direct distance method. The xy color gamut is indicated by 602, the chromaticities of each of the red, green and blue primary color emitters of a first bin LED are respectively indicated by 604-1R, 604-1G and 604-1B, and the chromaticities of each of the red, green and blue primary color emitters of a second bin LED are respectively indicated by 604-2R, 604-2G and 604-2B. The white point is indicated by 603 (which may, for example, be the white point of an RGB LED after calibration), and the illumination target value chromaticity is indicated by $xy_T$.

In the direct distance method, the weighting is determined by the ratios of distances in chromaticity space between the chromaticity of each color component of the LED bins to the illumination target value chromaticity. The values dbin1_r/g/b(i) represent the distances between bin1 red/green/blue chromaticities and the illumination target value of ith downsample block, and the values dbin2_r/g/b(i) represent the distances between bin2 red/green/blue chromaticities and the illumination target value of ith downsample block. The weightings in the direct distance method may be calculated as follows:

$$wR_{BIN1}(i) = \frac{\text{dbin2_r}(i)}{\text{dbin1_r}(i)}$$

$$wR_{BIN2}(i) = \frac{\text{dbin1_r}(i)}{\text{dbin2_r}(i)}$$

$$wG_{BIN1}(i) = \frac{\text{dbin2_g}(i)}{\text{dbin1_g}(i)}$$

$$wG_{BIN2}(i) = \frac{\text{dbin1_r}(i)}{\text{dbin2_r}(i)}$$

$$wB_{BIN1}(i) = \frac{\text{dbin2_b}(i)}{\text{dbin1_b}(i)}$$

$$wB_{BIN2}(i) = \frac{\text{dbin1_b}(i)}{\text{dbin2_b}(i)}$$

In some embodiments, the weightings may be normalized prior to being applied to the preliminary primary drive values. In some embodiments, the weightings may not be normalized, and the weighted drive values may be normalized based on the overall light intensity desired at each location. In some embodiments, no normalization may be done. For example, in some implementations using the direct distance method discussed above, the weightings may not be normalized in order to produce more saturated backlighting. In some implementations using the orthogonal projection method discussed below, the weightings may be normalized.

Figure 6B:
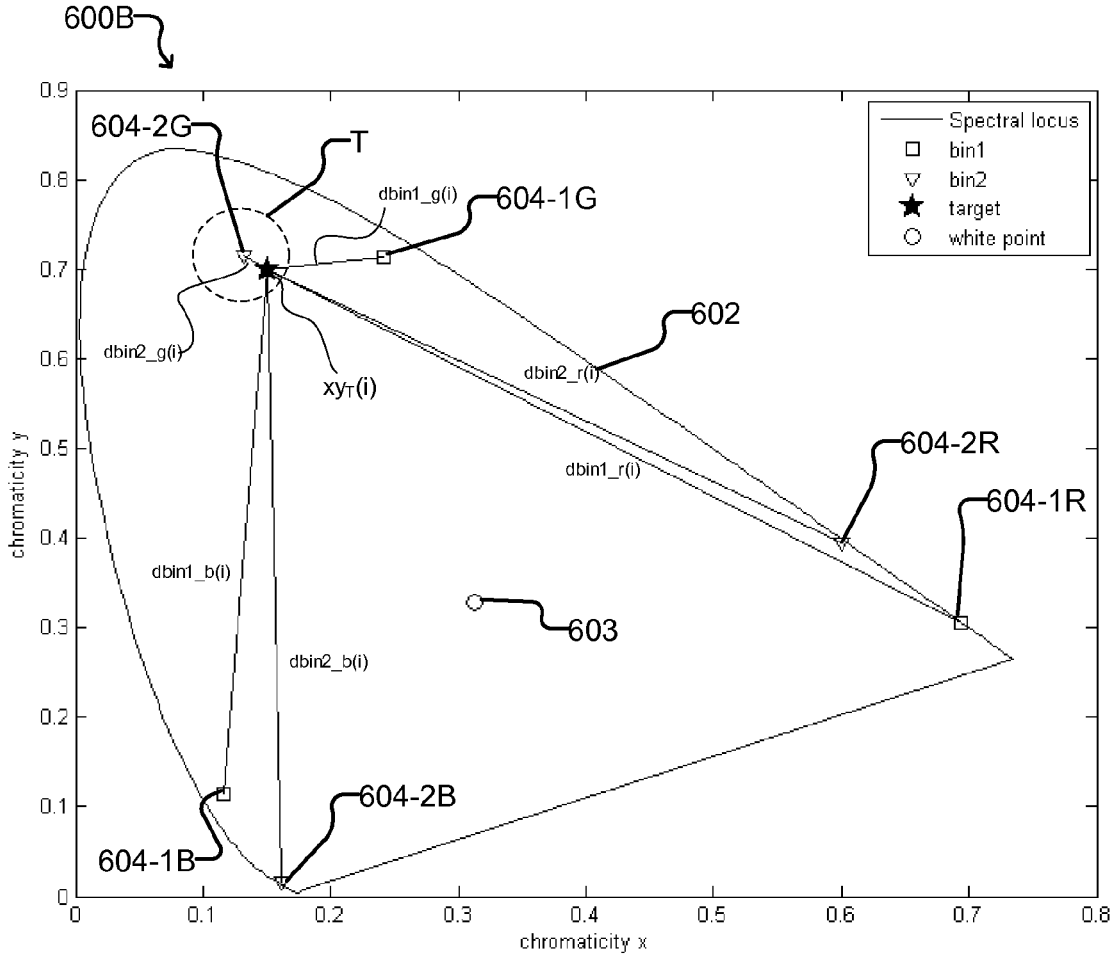

Additional nonlinear decision logic may be applied in some embodiments to determine weightings. For example, if the distance between a LED bin primary color emitter's chromaticty and the illumination target value is less than a threshold value T, the weighting for that primary color of that bin may be increased nonlinearly and the weighting for that primary color of the other bin may be reduced or set to zero. For example, FIG. 6B shows an example graph 600B wherein the illumination target value $xy_T(i)$ is so close to bin2 green 604-2G that the distance is less than the tolerance T. As a result, non-linear weighting is applied to the green component of the $RGB_{BIN1}(i)$ and $RGB_{BIN2}(i)$ in order to emphasize the green contribution from the LED from bin2. For example, in some embodiments the bin2 LED green weighting may be assigned a value of 1, and the bin1 LED green weighting may be assigned a value of 0 in the FIG. 6B example.

Figure 7A:
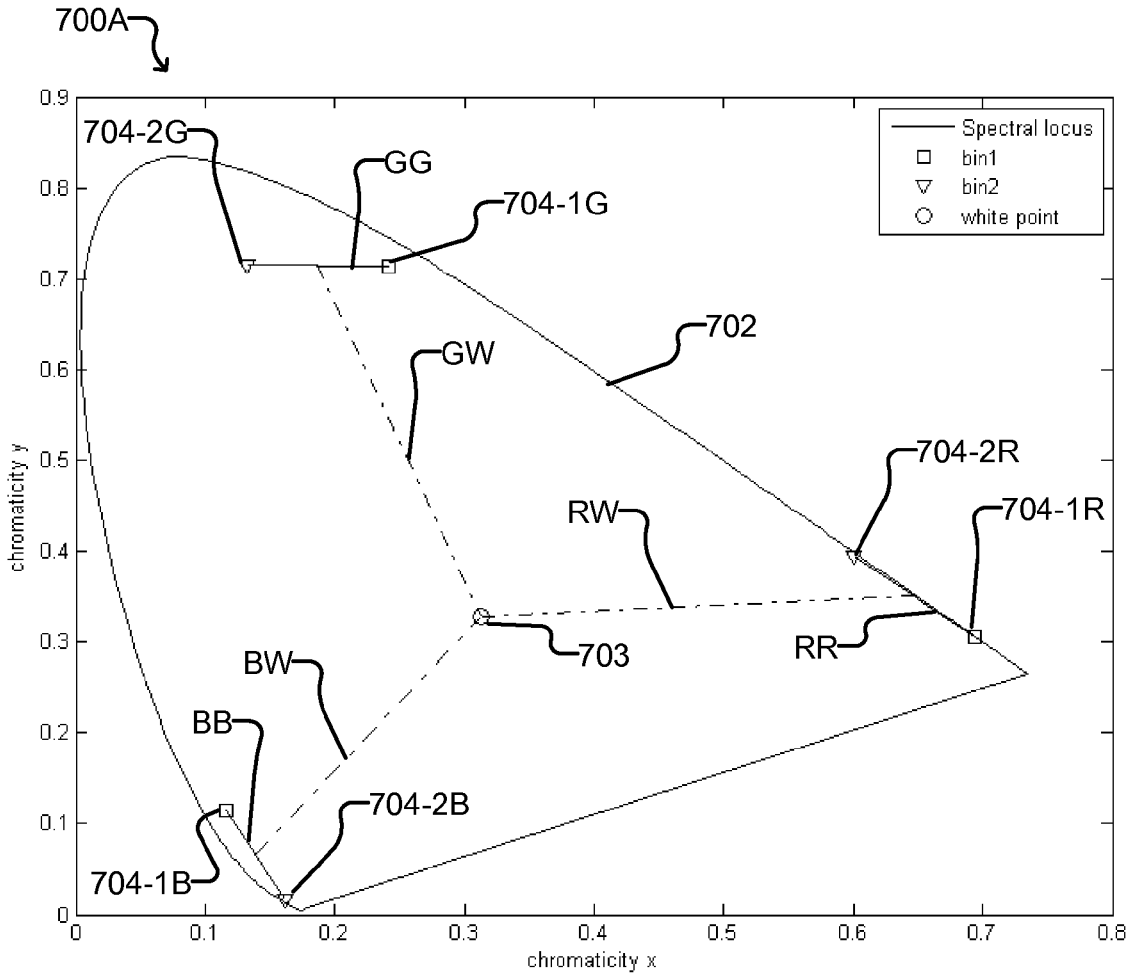
FIGS. 7A, 7B and 7C are example plots of primary colors of two different multi-primary light sources in chromaticity space, illustrating values used in calculating weightings for the of two different multi-primary light sources according to one embodiment.
Figure 7B:
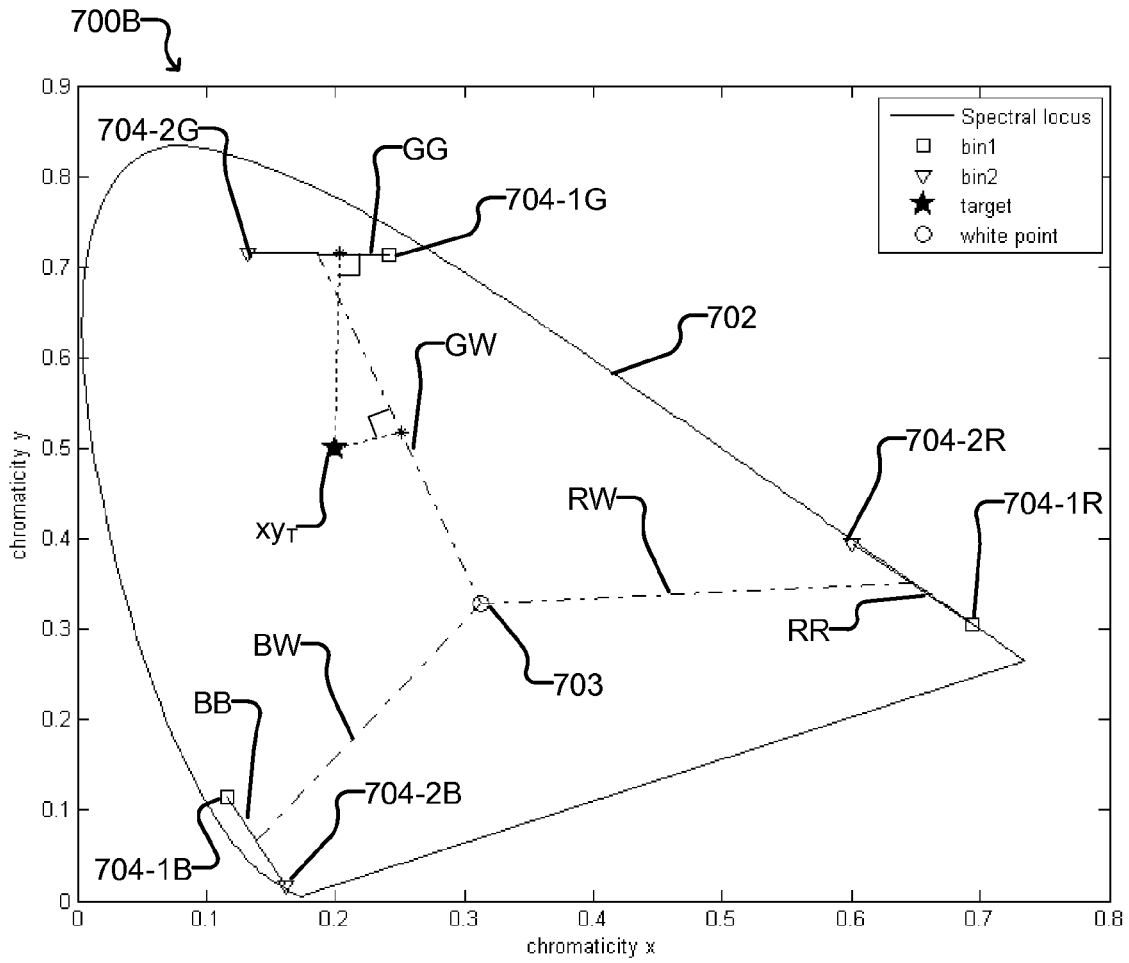
Figure 7C:
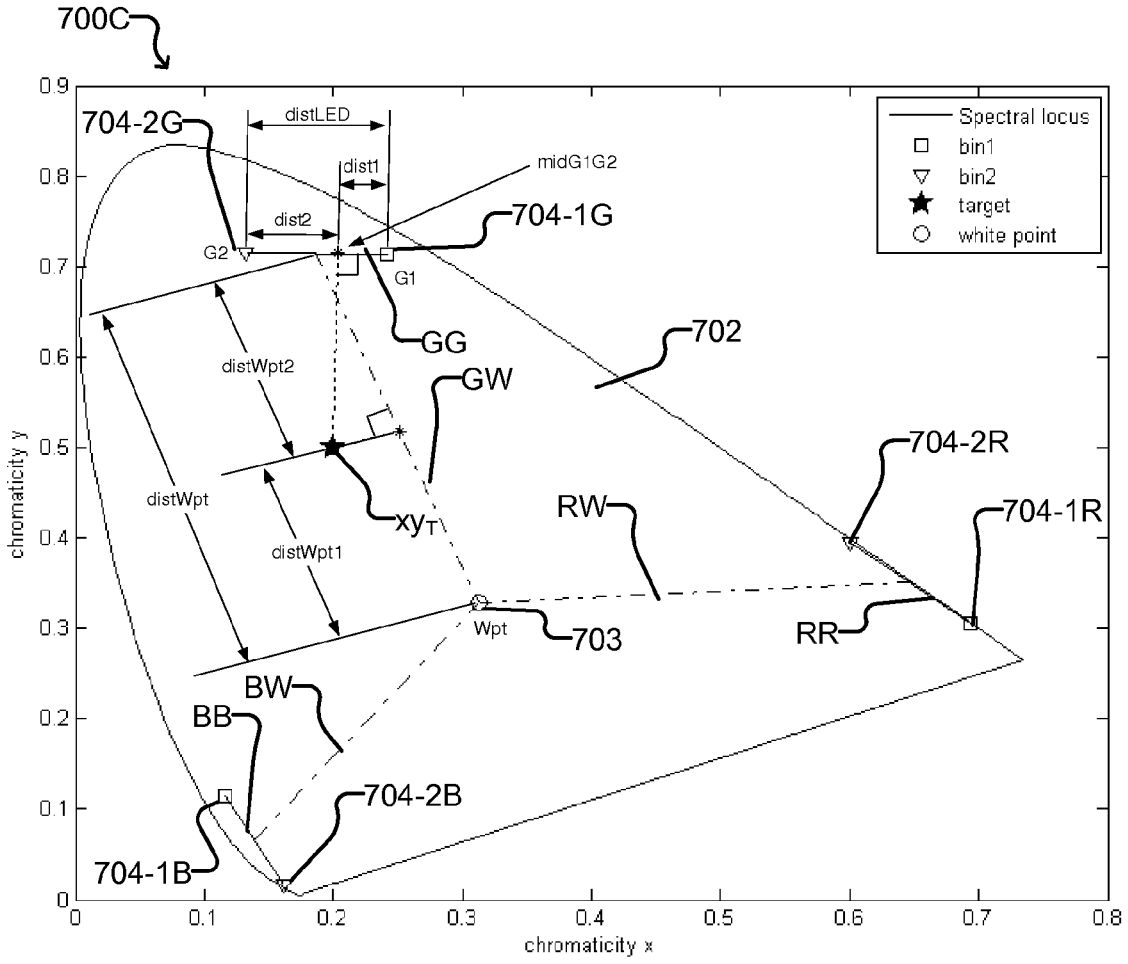

FIGS. 7A, 7B and 7C show example graphs 700A, 700B and 700C illustrating values used in determining weightings using the orthogonal projection method. The xy color gamut is indicated by 702, the chromaticities of each of the red, green and blue primary color emitters of a first bin LED are respectively indicated by 704-1R, 704-1G and 704-1B, the chromaticities of each of the red, green and blue primary color emitters of a second bin LED are respectively indicated by 704-2R, 704-2G and 704-2B, and the white point is indicated by 703 (which may, for example, be the white point of an RGB LED after calibration). The illumination target value chromaticity is indicated by $xy_T$. In the orthogonal projection method, the illumination target value chromaticity $xy_T$ is right-angle projected onto the line connected between corresponding primary colors of the LEDs of different bins. Line GG connects the green primary colors, line RR connects the red primary colors, and line BB connects the blue primary colors. The illumination target value chromaticity $xy_T$ is also right angle projected on to lines connecting the midpoints of each of lines GG, RR and BB and the white point 703. Line GW connects the white point to the midpoint of line GG. Line RW connects the white point to the midpoint of line RR. Line BW connects the white point to the midpoint of line BB. FIGS. 7B and 7C show an example of the green projections, with "*" indicating the projected location on each of line GG and GW. FIG. 7C shows distances used in calculating the green weightings.

The weighting is calculated for each illumination target value chromaticity $xy_T(i)$ by the combination of distance ratio along both projection lines. An example of calculating the green weightings is as follows, using the distances indicated in FIG. 7C:

$$w1(i) = \frac{dist2(i) - dist1(i)}{2 * distLED} + 0.5$$

$$wWpt(i) = \frac{distWpt1(i) - distWpt2(i)}{2 * distWpt} + 0.5$$

$$wG_{BIN1}(i) = w1(i) * wWpt(i) + 0.5 * (1 - wWpt(i))$$

$$wG_{BIN2}(i) = 1 - wG_{BIN1}(i)$$

The red and blue weightings may be calculated with corresponding equations.

An objective of the weighting parameter in some embodiments is to balance the drive level between the corresponding primary emitters of the 2 types of LEDs (or other light sources) in the region around white point. For each input target illumination value, 6 weightings are computed: red, green and blue weightings for Bin1 primary emitter drive values, and red, green and blue weightings for Bin1 primary emitter drive values.

After computing the weighting for each channel of the bin primaries (either through the direct distance method or the orthogonal projection method), the weighted primary drive values 511-1 to 511-N may be computed by multiplying the light source type-specific preliminary drive values 505-1 to 505-N by the weightings on a color by color basis.

Figure 8:
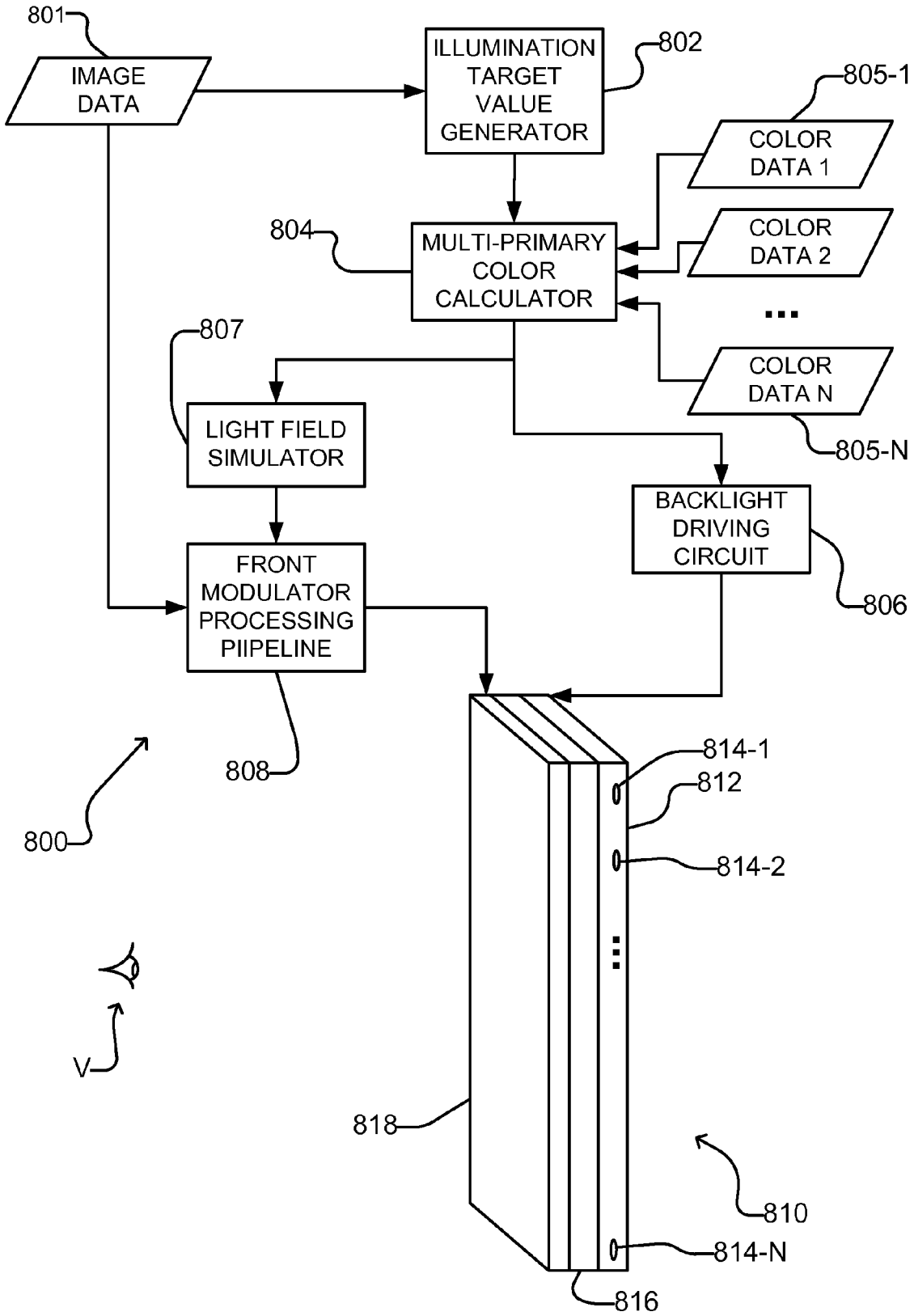
FIG. 8 is a block diagram of an apparatus according to one embodiment.

FIG. 8 schematically depicts an example apparatus 800 for calculating primary color drive values for a backlight 812 of a dual modulation display 810 according to one embodiment. Backlight 812 comprises an array of different types of multi-primary light sources 814-1, 814-2 . . . 814-N which illuminate a front modulator 818. An optical assembly 816 may be provided between backlight 812 and front modulator 818. Optical assembly 816 may comprise, for example, one or more of a gap, a diffuser, a collimator, one or more brightness enhancement films, one or more waveguides, or other optical elements.

An illumination target value generator 802 receives image data 801 and generates an illumination target value for locations corresponding to each of the light sources of backlight 812. A multi-primary color calculator 804 receives the illumination target values, and also color data 805-1 to 805-N for each type of light source of backlight 812. Multi-primary color calculator 804 may calculate primary color drive values for each primary color of each light source by methods such as those described above.

The primary color drive values are provided to a backlight driving circuit, which drives the light sources of backlight 812 accordingly. The primary color drive values are also provided to a light field simulator 807, which generates a predicted illumination pattern based on the primary color drive values and on known physical parameters of display 810, such as, for example, the locations of the light sources, the spread functions of the light sources, and the characteristics of optical assembly 816. Light field simulator 807 provides the predicted illumination pattern to a front modulator processing pipeline 808. By way of non-limiting examples, methods for generating the predicted illumination pattern are described in PCT Publication Nos. WO03/077013, WO2006/010244 and WO2008/092276, which are hereby incorporated herein by reference. In particular embodiments, light field simulation may be carried out by performing a two-dimensional convolution of each of the light source locations, weighted by the intensity of the light sources, with predetermined filter coefficients corresponding to the pattern of light generated by each light source.

Front modulator processing pipeline 808 also receives image data 801, and controls the transmissivity of each controllable element based on image data 801 and the predicted illumination pattern. A viewer V is thus presented with the desired image specified by image data through the combined effect of the spatially modulated illumination generated by backlight 812 (which is generally at a resolution substantially less than the desired image) and the spatial modulation provided by front modulator 818 (which is generally at a resolution equal to that of the desired image).

Where a component (e.g. a illumination target value generator, a multi-primary calculator etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Aspects of the invention may be provided in the form of a program product. The program product may comprise any non-transitory medium which carries a set of computer-readable information comprising instructions which, when executed by a data processor, cause the data processor to execute a method of the invention. Program products according to the invention may be in any of a wide variety of forms. The program product may comprise, for example, physical media such as magnetic data storage media including floppy diskettes, hard disk drives, optical data storage media including CD ROMs, DVDs, electronic data storage media including ROMs, flash RAM, or the like. The computer-readable information on the program product may optionally be compressed or encrypted.

Those skilled in the art will appreciate that certain features of embodiments described herein may be used in combination with features of other embodiments described herein, and that embodiments described herein may be practised or implemented without all of the features ascribed to them herein. Such variations on described embodiments that would be apparent to the skilled addressee, including variations comprising mixing and matching of features from different embodiments, are within the scope of this invention.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A method for backlighting a dual modulation display device comprising a front modulator illuminated by a backlight comprising a plurality of light sources of two or more types, each type of light source comprising a multi-primary light source having two or more primary color light emitters having different primary color characteristics from corresponding primary color emitters of other types of light source, the multi-primary light source of each type of light source comprising a red primary color emitter, wherein the plurality of the light sources of said two or more types are arranged as an array in alternating fashion, the method comprising:

i. receiving illumination target values for a plurality of locations on the front modulator corresponding to the plurality of light sources, each of the locations on the front modulator configured to be illuminated by two or more of the plurality of light sources;

ii. determining primary color drive values for each primary color for each type of light source based on the primary color characteristics for that primary color and the illumination target value for the location corresponding to that light source, wherein each adjacent two or more different types of horizontally neighboring light sources form a group and the primary color drive values are determined for each group wherein coupling factors of light spread energy from one light source to the respective other light sources of each group are postulated to be equal when determining said primary color drive values for said group and the red primary color emitter of each type of light source is forced to have the same primary drive value; and iii. driving the primary color light emitters of each type of light source based on the primary color drive values.

2. A method according to claim 1 wherein the primary color drive values for each type of light source are determined based on the primary color characteristics of that type of light source and the primary color characteristics of at least one other type of light source.

3. A method according to claim 1 comprising determining primary color drive values for a group of light sources selected based on locations and spread functions of the light sources.

4. A method according to claim 1 wherein determining primary color drive values comprises:

i. determining preliminary drive values for each light source based on the type of that light source;

ii. determining weightings for each primary color of each type of light source; and, iii. applying the weightings to the preliminary drive values.

5. A method according to claim 4 wherein determining the preliminary drive values for each light source comprises converting a fraction of the illumination target value corresponding to that light source to a color space corresponding to the primary color light emitters of that light source.

6. A method for backlighting a dual modulation display device comprising a front modulator illuminated by a backlight comprising a plurality of light sources of two or more types, each type of light source comprising a multi-primary light source having two or more primary color light emitters having different primary color characteristics from corresponding primary color emitters of other types of light source, the multi-primary light source of each type of light source comprising a red primary color emitter, wherein the plurality of the light sources of said two or more types are arranged as an array in alternating fashion, the method comprising:

i. receiving illumination target values for a plurality of locations on the front modulator corresponding to the plurality of light sources, each of the locations on the front modulator configured to be illuminated by two or more of the plurality of light sources;

ii. determining primary color drive values for each primary color for each type of light source based on the primary color characteristics for that primary color and the illumination target value for the location corresponding to that light source, wherein each adjacent two or more different types of horizontally neighboring light sources form a group and the primary color drive values are determined for each group wherein coupling factors of light spread energy from one light source to the respective other light sources of each group are postulated to be equal when determining said primary color drive values for said group and the red primary color emitter of each type of light source is forced to have the same primary drive value; and iii. driving the primary color light emitters of each type of light source based on the primary color drive values wherein determining primary color drive values comprises:

determining preliminary drive values for each light source based on the type of that light source;

determining weightings for each primary color of each type of light source; and, applying the weightings to the preliminary drive values and the method comprises determining the weightings by comparing target locations in chromaticity space of the illumination target values to primary locations in chromaticity space of light from the primary color light emitters.

7. A method according to claim 6 comprising determining the weightings based on distances between each primary location and the target location.

8. A method according to claim 7 wherein the weightings are based on a ratio of distances between each primary location and the target location.

9. A method according to claim 6 comprising determining the weighting for each primary color based on distances:

i. between the primary location of one type of light source and the corresponding primary location of another type;

ii. between a midpoint between corresponding primary locations and a white point;

iii. from an orthogonal projection of the target location onto a line passing through the corresponding primary locations to each primary location; and iv. from an orthogonal projection of the target location onto a line passing through the mid point and the white point to the mid point and to the white point.

10. Apparatus for generating backlight driving signals for a dual modulation display device comprising a front modulator illuminated by a backlight comprising a plurality of light sources of two or more types, each type of light source comprising a multi-primary light source having two or more primary color light emitters having different primary color characteristics from corresponding primary color emitters of other types of light source, the multi-primary light source of each type of light source comprising a red primary color emitter, wherein the plurality of the light sources of said two or more types are arranged as an array in alternating fashion, the apparatus comprising:

i. an illumination target value generator configured to generate illumination target values for a plurality of locations on the front modulator corresponding to the plurality of light sources, each of the locations on the front modulator configured to be illuminated by two or more of the plurality of light sources; and, ii. a multi-primary calculator configured to determine primary color drive values for each primary color of each type of light source based on the primary color characteristics for that primary color and the illumination target value for the location corresponding to that light source, wherein each adjacent two or more different types of horizontally neighboring light sources form a group and the primary color drive values are determined for each group wherein coupling factors of light spread energy from one light source to the respective other light sources of each group are postulated to be equal when determining said primary color drive values for said group and the red primary color emitter of each type of light source is forced to have the same primary drive value, and output the primary color drive values to a backlight driving circuit.

11. Apparatus according to claim 10 wherein the multi-primary calculator is configured to determine primary color drive values for each type of light source based on the primary color characteristics of that type of light source and the primary color characteristics of at least one other type of light source.

12. Apparatus according to claim 10 wherein the multi-primary calculator is configured to determine primary color drive values for a group of light sources selected based on locations and spread functions of the light sources.

13. Apparatus according to claim 10 wherein the multi-primary calculator is configured to determine primary color drive values for each light source independently based on the primary color characteristics of one or more neighboring light sources.

14. Apparatus according to claim 13 wherein the multi-primary calculator is configured to determine, for each light source, drive values for two or more types of light source and select the drive values for the type of light source corresponding to that light source.

15. Apparatus according to claim 10 wherein the multi-primary calculator is configured to determine primary color drive values by:

i. determining preliminary drive values for each light source based on the type of that light source;

ii. determining weightings for each primary color of each type of light source; and, iii. applying the weightings to the preliminary drive values.

16. Apparatus for generating backlight driving signals for a dual modulation display device comprising a front modulator illuminated by a backlight comprising a plurality of light sources of two or more types, each type of light source comprising a multi-primary light source having two or more primary color light emitters having different primary color characteristics from corresponding primary color emitters of other types of light source, the multi-primary light source of each type of light source comprising a red primary color emitter, wherein the plurality of the light sources of said two or more types are arranged as an array in alternating fashion, the apparatus comprising:

i. an illumination target value generator configured to generate illumination target values for a plurality of locations on the front modulator corresponding to the plurality of light sources, each of the locations on the front modulator configured to be illuminated by two or more of the plurality of light sources; and, ii. a multi-primary calculator configured to determine primary color drive values for each primary color of each type of light source based on the primary color characteristics for that primary color and the illumination target value for the location corresponding to that light source, wherein each adjacent two or more different types of horizontally neighboring light sources form a group and the primary color drive values are determined for each group wherein coupling factors of light spread energy from one light source to the respective other light sources of each group are postulated to be equal when determining said primary color drive values for said group and the red primary color emitter of each type of light source is forced to have the same primary drive value, and output the primary color drive values to a backlight driving circuit;

wherein the multi-primary calculator is configured to determine primary color drive values by:

determining preliminary drive values for each light source based on the type of that light source;

determining weightings for each primary color of each type of light source; and, applying the weightings to the preliminary drive values;

wherein the multi-primary calculator is configured to determine primary color drive values for each light source by converting a fraction of the illumination target value corresponding to that light source to a color space corresponding to the primary color light emitters of that light source.

17. Apparatus for generating backlight driving signals for a dual modulation display device comprising a front modulator illuminated by a backlight comprising a plurality of light sources of two or more types, each type of light source comprising a multi-primary light source having two or more primary color light emitters having different primary color characteristics from corresponding primary color emitters of other types of light source, the multi-primary light source of each type of light source comprising a red primary color emitter, wherein the plurality of the light sources of said two or more types are arranged as an array in alternating fashion, the apparatus comprising:

i. an illumination target value generator configured to generate illumination target values for a plurality of locations on the front modulator corresponding to the plurality of light sources, each of the locations on the front modulator configured to be illuminated by two or more of the plurality of light sources; and, ii. a multi-primary calculator configured to determine primary color drive values for each primary color of each type of light source based on the primary color characteristics for that primary color and the illumination target value for the location corresponding to that light source, wherein each adjacent two or more different types of horizontally neighboring light sources form a group and the primary color drive values are determined for each group wherein coupling factors of light spread energy from one light source to the respective other light sources of each group are postulated to be equal when determining said primary color drive values for said group and the red primary color emitter of each type of light source is forced to have the same primary drive value, and output the primary color drive values to a backlight driving circuit;

wherein the multi-primary calculator is configured to determine primary color drive values by:

determining preliminary drive values for each light source based on the type of that light source;

determining weightings for each primary color of each type of light source; and, applying the weightings to the preliminary drive values;

wherein the multi-primary calculator is configured to determine the weightings by comparing target locations in chromaticity space of the illumination target values to primary locations in chromaticity space of light from the primary color light emitters.

18. Apparatus according to claim 17 wherein the multi-primary calculator is configured to determine the weightings based on distances between each primary location and the target location.

19. Apparatus according to claim 18 wherein the multi-primary calculator is configured to determine the weightings based on a ratio of distances between each primary location and the target location.

20. Apparatus according to claim 17 wherein the multi-primary calculator is configured to determine the weighting for each primary color based on distances:

i. between the primary location of one type of light source and the corresponding primary location of another type;

ii. between a midpoint between corresponding primary locations and a white point;

iii. from an orthogonal projection of the target location onto a line passing through the corresponding primary locations to each primary location; and iv. from an orthogonal projection of the target location onto a line passing through the mid point and the white point to the mid point and to the white point.

* * * * *